US006343491B1

(12) United States Patent
Jung

(10) Patent No.: US 6,343,491 B1
(45) Date of Patent: Feb. 5, 2002

(54) AUTOMATIC WET TOWEL SUPPLYING APPARATUS

(76) Inventor: Nak-Won Jung, Apt. #308-1402, Hangaram Apt., 1586 Kwanyang-Dong, Dongan-Ku, Anyang-City, Kyungki-Do (KR)

( * ) Notice: Subject to any disclaimer, the term of this patent is extended or adjusted under 35 U.S.C. 154(b) by 0 days.

(21) Appl. No.: 09/525,836

(22) Filed: Mar. 15, 2000

(30) Foreign Application Priority Data

Aug. 26, 1999 (KR) ..... 99-35708
Dec. 9, 1999 (KR) ..... 99-56272

(51) Int. Cl.[7] ..... D06F 29/00

(52) U.S. Cl. ..... 68/13 R; 68/205 R; 118/325; 118/235

(58) Field of Search ..... 68/13 R, 205 R, 68/175; 118/325, 235; 134/64 R, 122 R

(56) References Cited

U.S. PATENT DOCUMENTS 3,672,552 A * 6/1972 Krueger et al.
3,707,945 A * 1/1973 Boone
3,749,313 A * 7/1973 Weitman
3,862,616 A * 1/1975 Brady
4,041,900 A * 8/1977 Charles
4,104,814 A * 8/1978 Whight
4,655,377 A * 4/1987 Orange, Jr. et al.
4,790,490 A * 12/1988 Chkravorty
4,846,412 A * 7/1989 Morand
4,984,530 A * 1/1991 Dutton
5,048,386 A * 9/1991 Deluca et al.
5,078,033 A * 1/1992 Formon
5,257,711 A * 11/1993 Wirtz-Odenthal
5,375,920 A * 12/1994 Cassia
5,410,930 A * 5/1995 Deluca et al.
5,443,084 A * 8/1995 Saleur
5,672,206 A * 9/1997 Gorman
6,224,010 B1 * 5/2001 Morand
6,231,747 B1 * 5/2001 Fukuzuka et al.

* cited by examiner

*Primary Examiner*—Frankie L. Stinson
(74) *Attorney, Agent, or Firm*—Lee & Hong

(57) ABSTRACT

An automatic wet towel supplying apparatus is disclosed. The automatic wet towel supplying apparatus comprises a housing, a casing, pulling means, cutting means, water supplying means and control means. The housing includes a cloth holding part for rotatably holding cloth in the form of a roll so that the cloth is pulled away and a towel storage chamber for storing wet towels for supply. The casing is fixed to the front portion of the interior of the housing by means of bolts so as to be easily removed from the housing. The cutting means includes a second motor, a rotary cutter rotated by the second motor, and a stationary cutter. The water supplying means is mounted in the housing, includes a water storage tank, a pump, a filtering unit and a nozzle, and serves to spray water on the cut towels. The control means includes a control board mounted on an outer surface of the housing, a first sensor for sensing a length of the cloth that is pulled by the pulling means, a second sensor for sensing a total number of rotations of the rotary cutter of the cutting means, and a microprocessor for controlling power supply to the first motor, the second motor and the pump by processing the signals from the control board, the first sensor and the second sensor.

11 Claims, 7 Drawing Sheets

AUTOMATIC WET TOWEL SUPPLYING APPARATUS

BACKGROUND OF THE INVENTION

1. Field of the Invention

The present invention relates, in general, to an automatic wet towel supplying apparatus and, more particularly, to an automatic wet towel supplying apparatus that supplies wet towels after cutting cloth into multiple towels to a certain length and wetting the towels.

2. Description of the Prior Art

As well known to those skilled in the art, a wet towel made of cloth or paper is provided in the form of a sheet in various ways so as to allow the hands to be cleaned using it. In addition, to such an end, a warm air supplying apparatus has been provided. In particular, the wet towel made of cloth is provided in the form of a roll so as to allow the hands to be cleaned easily in a place, such as a restaurant. However, since the wet towel is repeatedly laundered for reuse, a great deal of problems occur in regard to sanitation.

In order to overcome the problems, one or more wet towels made of material such as cloth or paper and packed in a vinyl envelope are provided for one time use. This approach is satisfactory for sanitation, but a manufacturing cost is increased and vinyl envelopes become disposable waste.

In order to solve the problems, a wet towel supplying apparatus, in which wet towels are supplied after cutting paper, cloth or non-woven fabric into multiple towels to a certain length and wetting the towels, is provided.

Such an apparatus is disclosed in U.S. Pat. No. 5,829,278. According to the patent, towel cloth wound in the form of a roll is spread by a pulling means. The spread cloth is cut into multiple towels to a certain length. The cut towels are wetted by spraying water on the towels while being moved toward a conveyor belt. The wet towels are respectively wound in the form of a roll. Afterwards, the wound wet towels are respectively supplied out of the apparatus.

However, in the patented apparatus, a conventional towel winding means comprises a U-shaped casing that is fixed around the conveyor belt and a pad that has a plurality of projections formed on its inner surface, thereby supplying only limited lengths of wet towels. In accordance with user's requests, it is preferably to supply various lengths of wet towels. Therefore, according to the patented apparatus, when a user requires a lengthier wet towel, the user stops and operates the apparatus again and takes one or more wet towels out of the apparatus. This causes the waste of resources and is troublesome to the user.

In addition, according to the patented apparatus, the pulling means and a cutting means are connected to a single motor and operated at the same time. Since the pulling means and the cutting means are rotated by means of the single motor, the length of a cut towel may not be controlled. Additionally, since the pulling means and the cutting means are respectively mounted to a housing, the maintenance and the cleaning of the apparatus is not easy. Furthermore, due to its mechanical design, such as having a cam, the noise of the apparatus is significantly loud.

SUMMARY OF THE INVENTION

Accordingly, the present invention has been made keeping in mind the above problems occurring in the prior art, and an object of the present invention is to provide an automatic wet towel supplying apparatus that is capable of supplying various lengths of wet towels.

Another object of the present invention is to provide an automatic wet towel supplying apparatus that reduces noise and is operated properly.

A further object of the present invention is to provide an automatic wet towel supplying apparatus that allows a pulling means and a cutting means to be easily removed, thereby allowing the maintenance and the cleaning of the apparatus to be easily performed.

In order to accomplish the above object, the present invention provides an automatic wet towel supplying apparatus, comprising a housing including a cloth holding part for rotatably holding cloth in the form of a roll so that the cloth is pulled away and a towel storage chamber for storing cut, wet towels for supply, a casing that is fixed to the front portion of the interior of the housing by means of bolts so as to be easily removed from the housing, means for pulling the cloth while compressing the cloth, cutting means that includes a second motor, a rotary cutter rotated by the second motor, and a stationary cutter fixed at a position in which the stationary cutter intersects the rotary cutter, water supplying means being mounted in the housing, including a water storage tank, a pump, a filtering unit and a nozzle, and serving to spray water on the cut towels, and a control means that includes a control board mounted on an outer surface of the housing, a first sensor for sensing a length of the cloth that is pulled by the pulling means, a second sensor for sensing a total number of rotations of the rotary cutter of the cutting means, and a microprocessor for controlling power supply to the first motor, the second motor and the pump by processing the signals from the control board, the first sensor and the second sensor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The present invention relates to an automatic wet towel supplying apparatus that supplies wet towels after cutting cloth into multiple towels to a certain length and wetting the towels.

A preferred embodiment of the present invention for accomplishing the above objects is described as follows.

Figure 1:
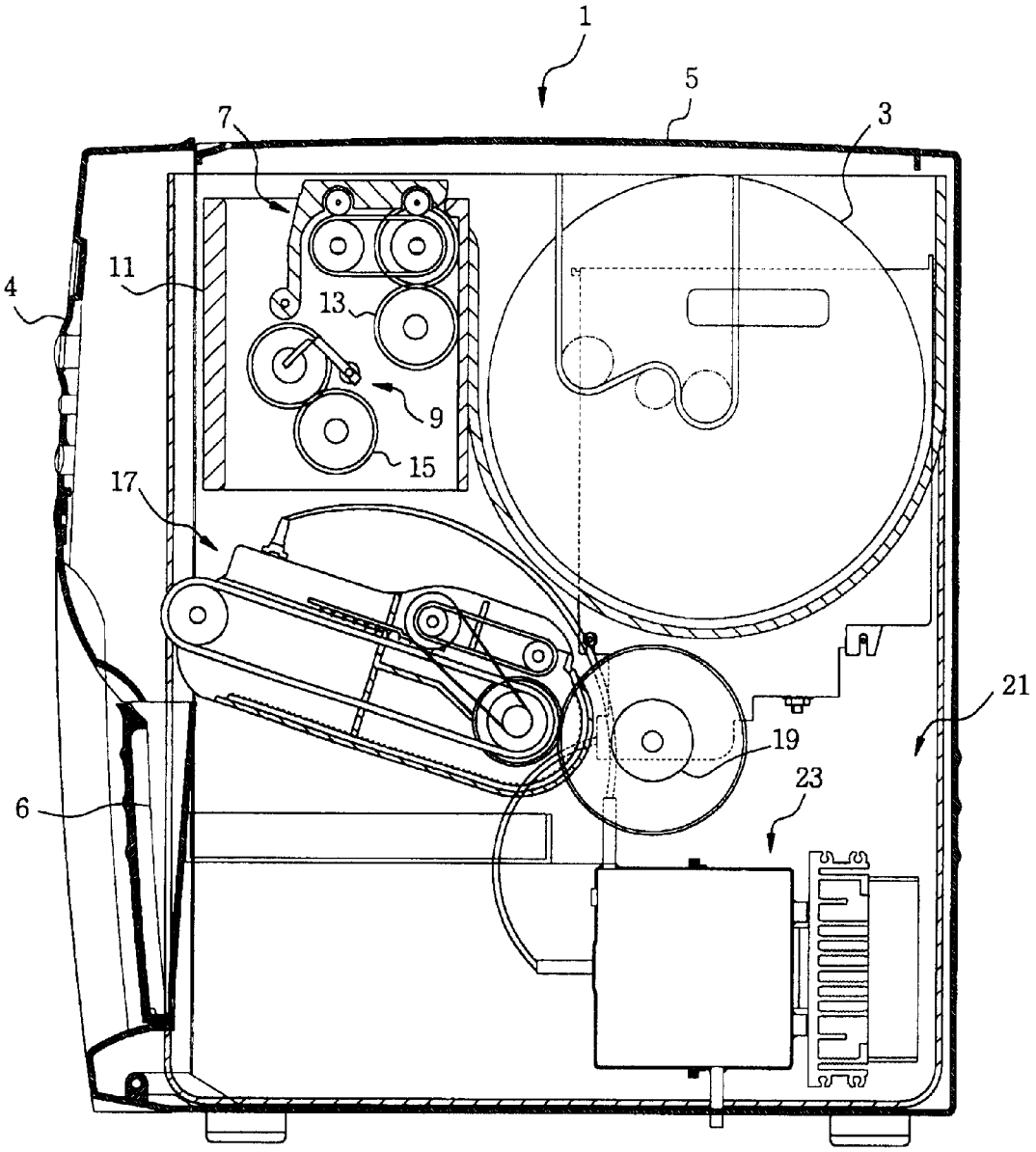
FIG. 1 is a partially cut-away side view showing the entire construction of an automatic wet towel supplying apparatus according to a preferred embodiment of the present invention.

FIG. 1 is a partially cut-away cross section showing the entire construction of the wet towel supplying apparatus that includes a pulling means and a cutting means.

Cloth 3, such as non-woven fabric, which is wound in the form of a roll, is positioned in the rear portion of the interior of an upstanding housing 5. A control board 4 is disposed in the front surface of the housing 5. A wet towel storage chamber 6 is positioned in the lower front portion of the housing 5. The pulling means 7 and the cutting means 9 mounted in a casing 11 are positioned in front of the cloth 3. The cloth 3 is inserted into the pulling means 7 that is operated by a first motor 13, and is pulled toward the cutting means 9.

The cutting means 9 using a known cutting method (in which a rotating cutter and a stationary cutter cooperate to cut an object) is operated by a second motor 15 and is positioned below the pulling means 7. A towel winding means 17 is operated by a third motor 16 and is connected to a nozzle of a water supplying means 21. An auxiliary water storage tank 23 is positioned in the lower portion of the housing 5 and includes a temperature regulating means and a pump, the temperature regulating means comprising a known electric heater or a known heat exchanger.

Figure 2:
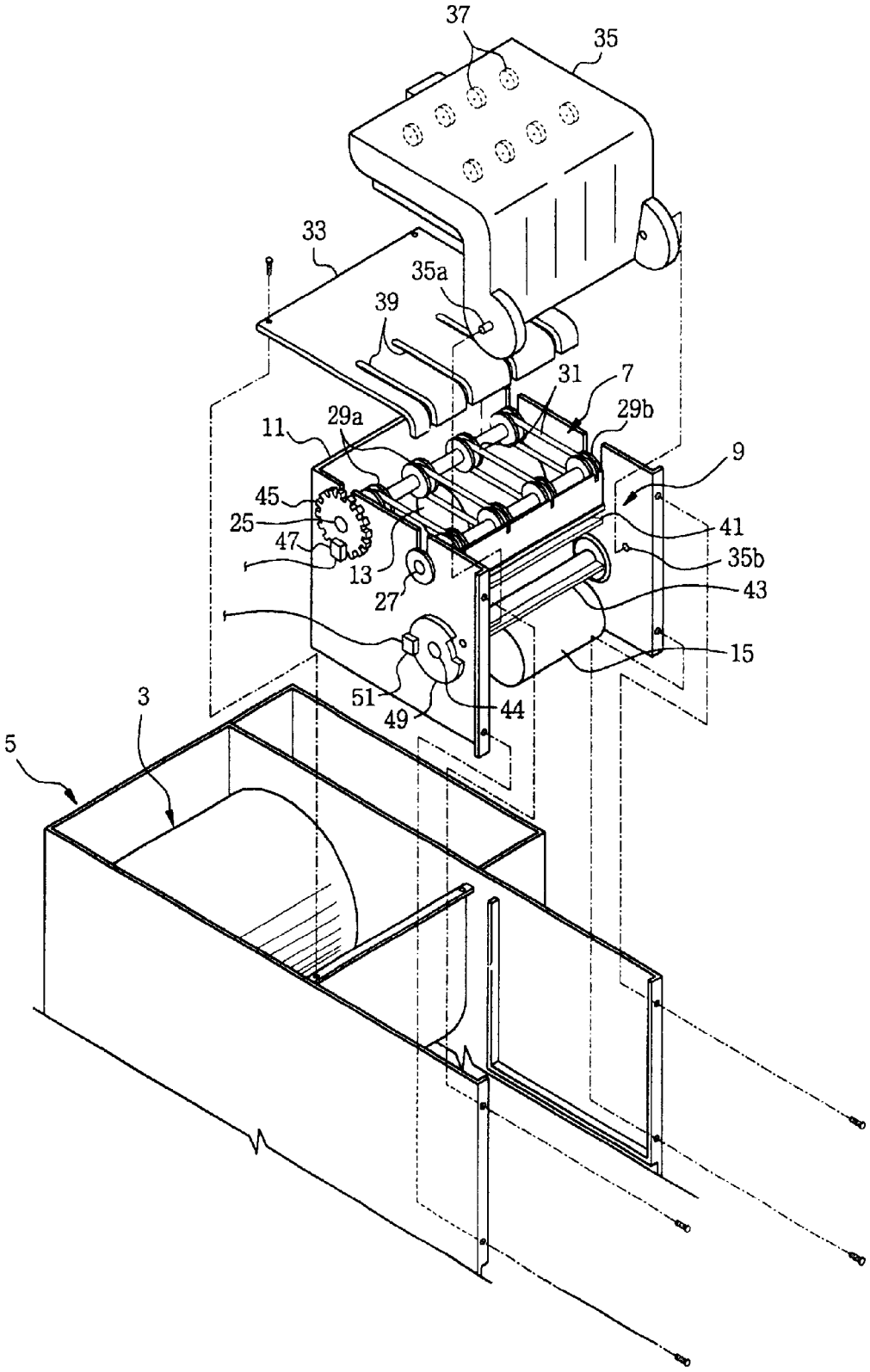
FIG. 2 is a perspective view showing a pulling means and a cutting means mounted to a casing that is separated from a housing.
Figure 3:
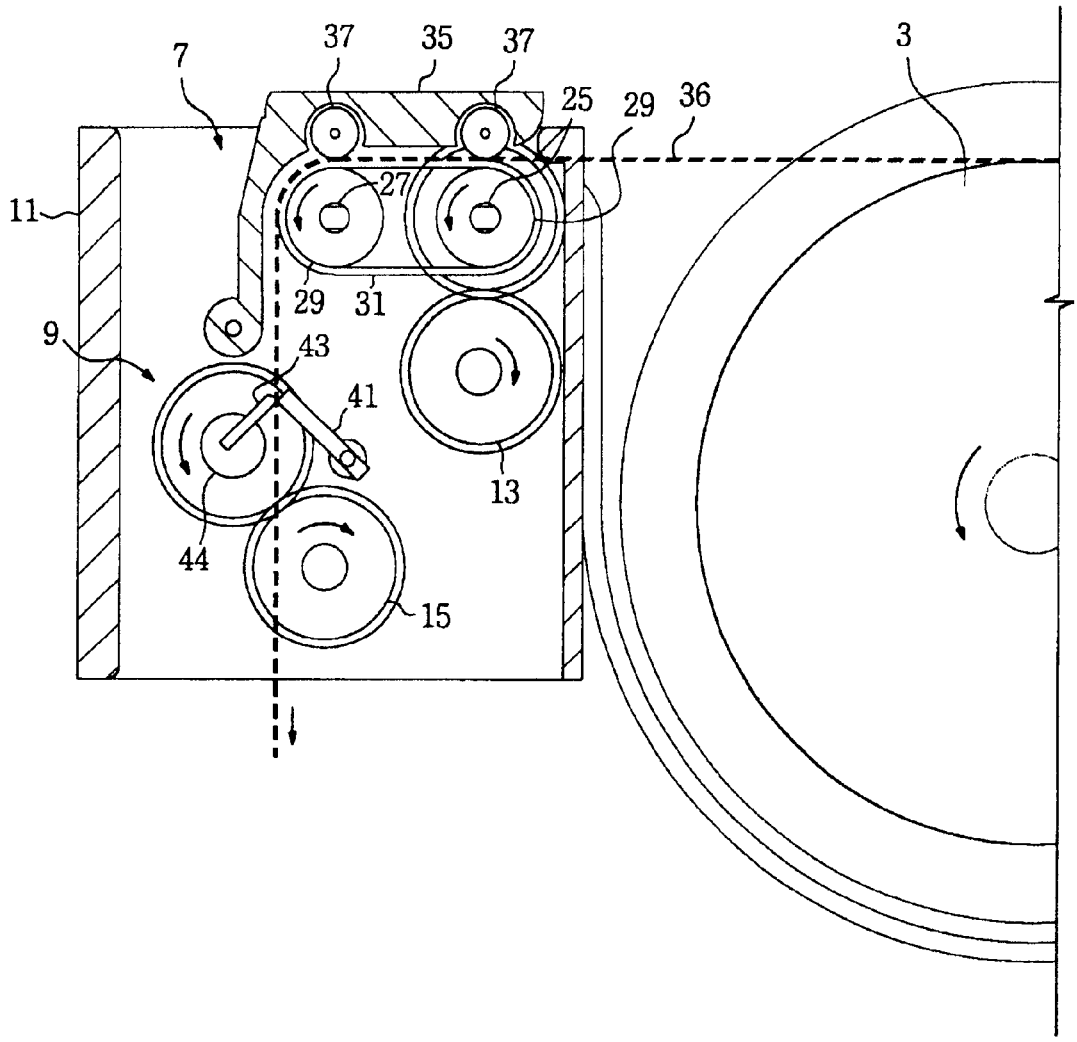
FIG. 3 is a side view showing the operation of the pulling means and the cutting means.

FIG. 2 is an exploded perspective view showing the pulling means 7 and the cutting means 9 that are mounted in the casing 11. FIG. 3 is a vertical cross section showing the operation of the pulling means 7 and the cutting means 9.

Referring to FIGS. 2 and 3, the pulling means 7 and the cutting means 9 are mounted in the casing 11. The casing 11 is fixed to the housing 5 by means of bolts, thereby allowing the casing 11 to be easily mounted and removed.

The pulling means 7 includes a first shaft 25 and a second shaft 27 that are rotated by means of the first motor 13. The first shaft 25 is connected to the rotating shaft of the first motor 13 through gears. The second shaft 27 is mounted to the casing 11, with the second shaft 27 being parallel to the first shaft 25. The first shaft 25 and the second shaft 27 are operated together by means of pulleys 29*a*, 29*b* and bands 31, with the pulleys 29*a*, 29*b* being mounted along the first shaft 25 and the second shaft 27 and the bands 31 passing a pair of opposing pulleys 29*a*, 29*b*.

The pulling means 7 further comprises a rake-shaped guide plate 33 and an L-shaped bent cover 35. The guide plate 33 is fixed to the upper portion of the housing 5 at its one side by means of bolts so as to be positioned over the pulling means 7. The cover 35 is fixed to the casing 11 with the fixing projections 35*a* of the cover 35 being inserted into the fixing holes 35*b* of the casing 11, so as to cover the upper portion and a front portion of the casing 11. A plurality of rollers 37, which are in contact with the upper surface of the cloth 36 (refer to FIG. 3), are situated at corresponding spots at which the bands 31 are located. The rollers 37 are extruded downwards from the lower surface of the cover 35 by elastic means such as springs.

The cloth 36 passes through the space between the upper surface of the guide plate 33 and the rollers 37. Guide slits 39 (refer to FIG. 3) are formed along the length of the guide plate 33 at positions that correspond to the positions of bands 31. When the apparatus is assembled, the bands 31 are projected from the upper surface of the guide plate 33 through the guide slits 39 and are rotated.

The rollers 37 are mounted so as to correspond to the bands 31, and so press against the upper surfaces of the bands 31. The rollers 37 are elastically mounted in the cover 35 so as to be elastically moved upwards and downwards, and so press against the bands 37 with a constant force. Therefore, the cloth 36 may be inserted into the space between each of the rollers 37 and each of the bands 31.

The cutting means 9 comprises a fixed cutter 41 that is mounted under the front end of the pulling means 7 and a rotary cutter 43 that is rotated in response to a signal transmitted from a control means (not shown). The rotary cutter 43, which is inserted to a certain depth along the length of the rotating cutter shaft 44, is connected to the second motor 15 through gears.

Since a cutting method, in which an object is cut by intersecting two cutters, is known, the description on the cutting method is simplified here. The rotary cutter 43 is mounted along the entire length of the cutter shaft so as to be projected uniformly. As shown in FIG. 3, the cloth 36 is cut when the cutters 41 and 43 are intersected.

According to one feature of the present invention, the pulling means 7 and the cutting means 9 are individually operated by different motors 13 and 15. Such a construction allows a user to regulate the length of a wet towel freely using a tachometer. To this end, the pulling means 7 comprises a rotating plate 45 and a first sensor 47 as a rotation sensing means, the rotating plate 45 being connected to a rotating shaft 25 and the first sensor 47 being connected to the rotating plate 45. The cutting means 9 has a cam plate 49 and a second sensor 51, the cam plate 49 being connected to the rotating cutter shaft 4.

The control board 4 has a control part, such as a keypad or buttons, and a display. The control board 4 is used to regulate the length of the towel and set the temperature of the water.

A control means (not shown) comprises the control board 4 (refer to FIG. 3), the first sensor 47, the second sensor 51, a microprocessor and a temperature control unit. The first sensor 47 senses the length of the cloth that is pulled by the pulling means 7. The second sensor 51 senses the total number of the rotation of the rotary cutter of the cutting means. The microprocessor controls power supply to the first motor, the second motor and the pump of the water supplying means by processing the signals from the control board 4, the first sensor 47 and the second sensor 51. The temperature control unit controls the cooling means and the heating means of the water storage unit in response to the signal from the control board 4.

If the apparatus is operated while the length of the towel is set to be 300 mm, the first sensor 47 of the pulling means 7 transmits a signal to the control means when 300 mm of the cloth is pulled. The control means that received this signal operates the second motor 15. Since one rotation of the rotating cutter shaft 44 is sufficient for cutting the cloth, the second sensor 51 transmits a signal to the control means when the second sensor 51 senses one rotation of the rotating cutter shaft 44. The control means that received this signal stops the second motor 15. Additionally, the control means stops the first motor 13 of the pulling means 7 while the cutting means 9 cuts the cloth.

Incidentally, the control means may control the total number of supplied towels. That is, if the apparatus is operated while a user sets the desired number of towels to be three using the control board 4 (refer to FIG. 1), the control means may control the apparatus so as to supply three towels. To this end, the cutting means 9 may be provided with a counter.

Figure 4:
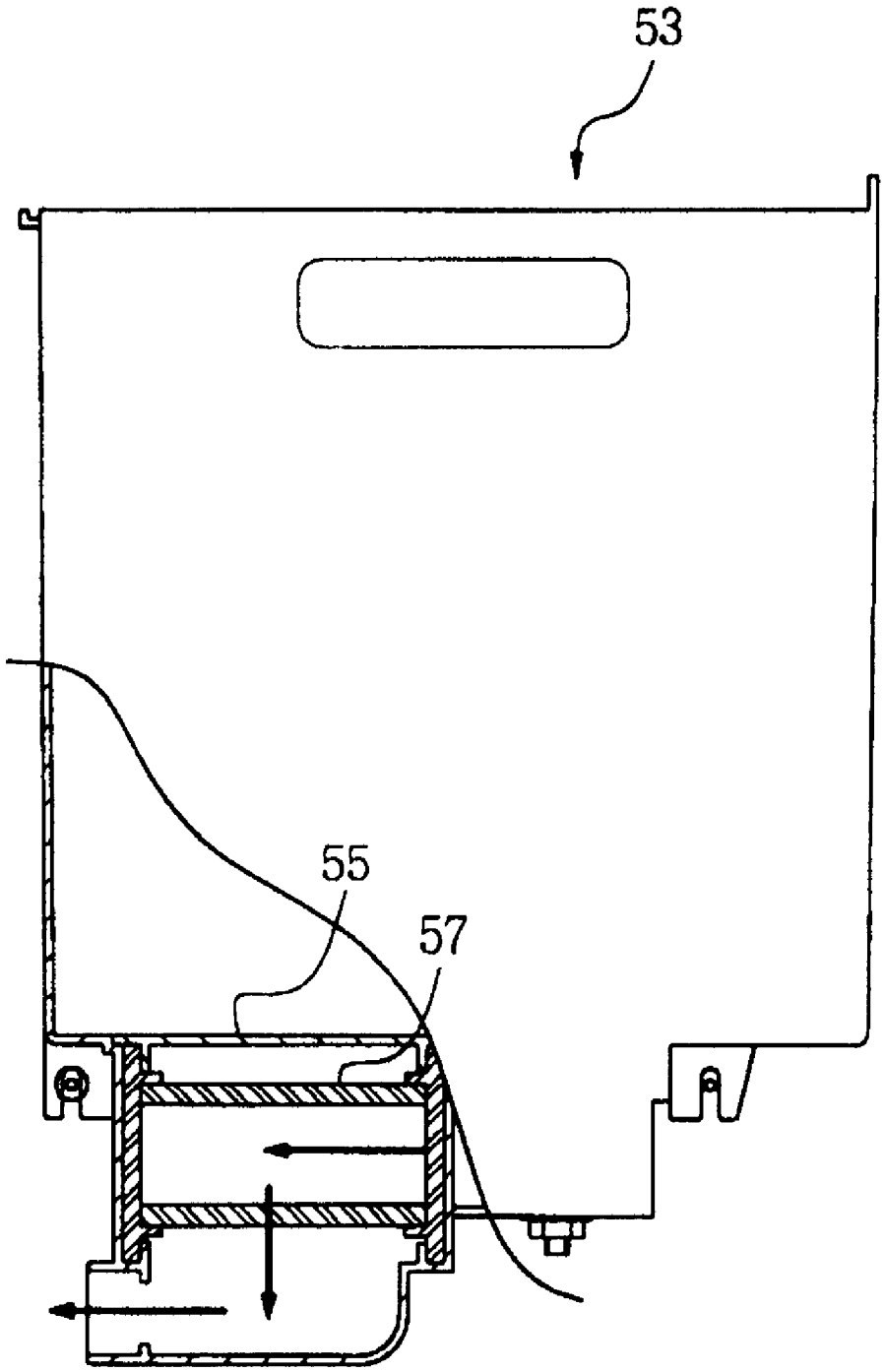
FIG. 4 is a partially cut-away cross section of a water tank showing the improvement in the filtering unit of a water supplying means.

FIG. 4 is a partially cut-away cross section of a water tank showing the improvement in the filtering unit of the water supplying means.

The water tank 53 has a filter unit that is connected to the main body of the water tank 53. The filter of the filter unit is easily removed while a cap 55 is opened. The water in the water tank is supplied to the auxiliary water storage tank 23 (refer to FIG. 1) along the arrows of FIG. 4. This construction makes the replacement of the filter easy and the apparatus simple.

The automatic wet towel supplying apparatus may be constructed in the form of a vending machine (not shown) Such a type of an apparatus may be used in an opened area.

Figure 5:
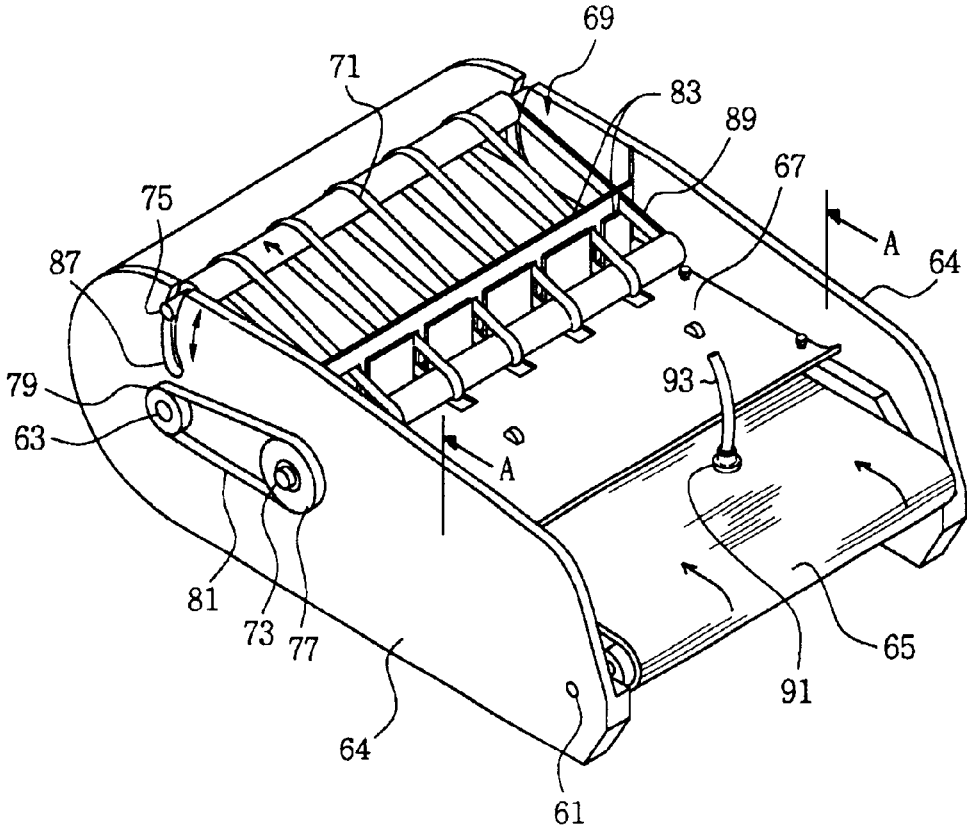
FIG. 5 is a perspective view showing a wet towel winding means that is removed from the housing.
Figure 6:
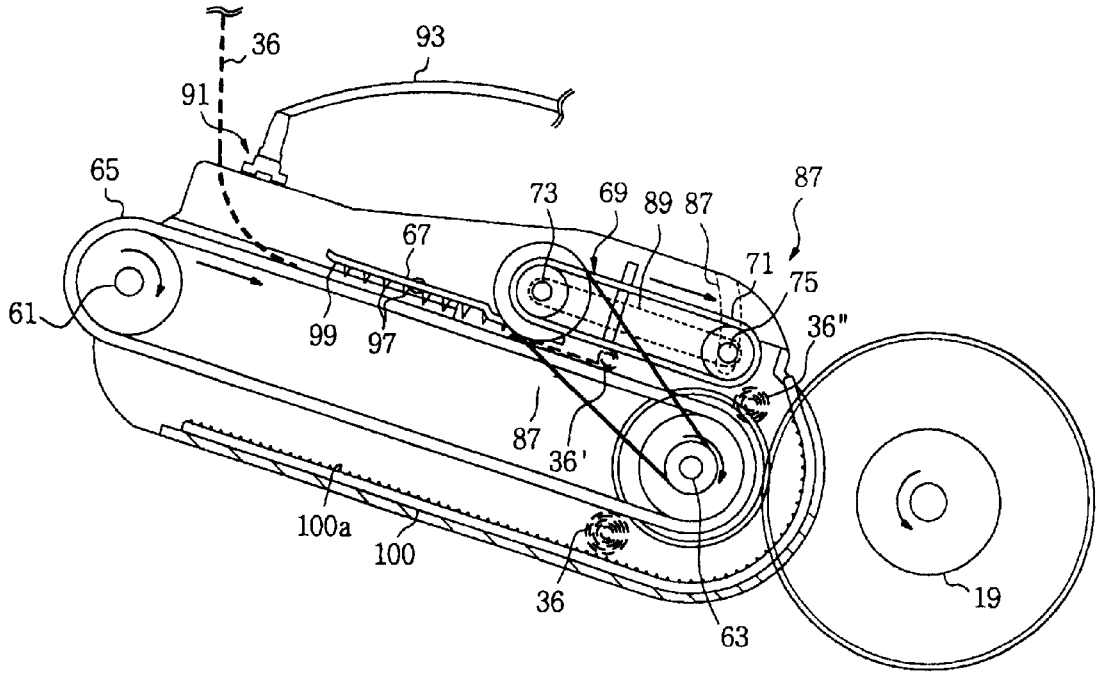
FIG. 6 is a side view showing the operation of the wet towel winding means.

The towel winding means 17 is a characteristic of the present invention. FIG. 5 is a perspective view showing the towel winding means according to the present invention. FIG. 6 is a side view showing the operation of the towel winding means. Referring to FIGS. 5 and 6, the towel winding means is described, hereinafter.

A third shaft 61 and a fourth shaft 63 are rotatably mounted between both side plates 64 that form a frame, the third shaft 61 and the fourth shaft 63 being spaced apart from each other. A rubber belt 65 passes around the third shaft 61 and the fourth shaft 63 and serves as a movement transmitting means. The fourth shaft 63 is connected to a fourth motor 19 (refer to FIG. 1) by means of gears and serves as a driving shaft, while the third shaft 61 serves as a driven shaft by means of the rubber belt 65. Additionally, the rubber belt 65 serves as a conveyor belt that moves cut towels toward the fourth shaft 63. The rubber belt 65 may have a rugged surface so as to prevent the removal of the towel on its surface. Preferably, the rubber belt 65 may have a known configuration for winding the towels effectively.

A spread plate 67 is mounted between the side plates 64, the spread plate 67 being vertically spaced apart from the rubber belt 65.

An auxiliary winding means 69 is provided in the rear of the spread plate 67. The auxiliary winding means 69 comprises a fifth shaft 73 and a sixth shaft 75 that are rotated together by means of one or more ring belts 71.

The fifth shaft 73 and the fourth shaft 63 are rotated together by means of pulleys 77 and 79 and a movement transmitting belt 81. For the movement transmitting belt 81, a rubber belt, which is operated quietly and is resistant to humidity, may be employed and, more preferably, a timing belt may be employed so as to prevent unexpected removal.

As shown in FIG. 5, the ring belts 71 may be made of silicon and may be arranged to be spaced apart from each other. Consequently, although any one of the ring belts 71 is cut, it is not needed to change all the ring belts 71. However, since it may be difficult to keep uniform tension when such ring belts 71 are employed, one wide ring belt may be employed.

A guide member 83 does not prevent only the lateral movement of the ring belts 71 but also prevents the towels from getting out of space between the ring belts 71. As shown, the guide member 83 is inserted into the grooves 85 that are vertically formed on the inner surfaces of the side plates 64.

The sixth shaft 75, which is connected to the fifth shaft 73, is mounted to be able to be moved upwards for the increasable diameter of the towel is increased in the process of winding the towel. To this end, two curved slots 87 are formed in the side plates 64.

A bracket 89 is positioned between the fifth shaft 73 and the sixth shaft 75 so as to keep a constant distance between the fifth shaft 73 and the sixth shaft 75.

The rubber belt 65 may be provided with a plurality of discharge holes (not shown) of small diameters. According to this construction, residual water that is sprayed on the towels falls down through the discharge holes while the towels are moved.

A nozzle 91, which is a part of the water supplying means 21, is positioned in front of the towel winding means 17. The nozzle 91 is provided with a plurality of injection holes with the injection holes facing downwards. Water is supplied to the nozzle 91 through a water supplying pipe 93. Nozzle can be provided in the form of pipe that is fixed at plates 64. According to this construction, water is uniformly sprayed on the towels that are moved by the rubber belt 65.

Figure 7:
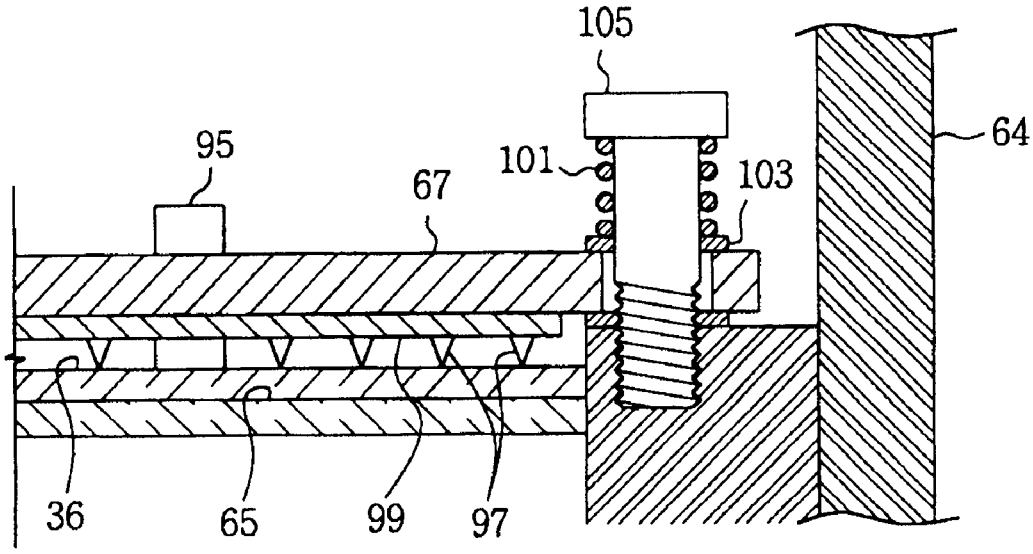
FIG. 7 is a cross section taken along line A—A of FIG. 5.

As shown in FIG. 7, a conveying roller 95 is mounted to the spread plate 67 so as to convey the towel 36' properly.

Referring to FIG. 7, the spread plate 67 includes a rubber plate 99 that has a plurality of tiny, sharp projections 97. The projections 97 are arranged over the one surface of the rubber plate 99 and, preferably have cone-shapes, respectively. Since the lengths of the projections 97 become shorter toward the rear of the apparatus, the gap between the spread plate 67 and the rubber belts 65 becomes wider, thereby moving the towels to the auxiliary winding means 69 while the towel is wound somewhat. The projections 97 spread the moved towels uniformly like a comb and remove residual water from the towels. The removed residual water may be eliminated through the discharge holes (not shown).

A support plate 100 allows the wound towels, which pass the sixth shaft 75, to be moved to the wet towel storage chamber 6 (refer to FIG. 1), with the wound towels being in contact with the rubber belt 65. The support plate 100 is spaced apart from the rubber belt 65 and is extended so as to surround the rear portion of the rubber belt 65 and the lower portion of the rubber belt 65. The support plate 100 has a plurality of projections **100*a*** along its inner surface, which is in contact with the towels, so as to prevent the slip of the towels.

As a result, the cut, wet towels 36, 36' and 36" are moved while laid on the upper surface of the rubber belt 65. After residual water is removed from the towels and the towels are spread while the towels are passing the projections 97 of the spread plate 67, the towels reach the fifth shaft 73. Subsequently, the wet towels pass the sixth shaft 75 while wound by means of the ring belts 71 that pass the fifth shaft 73 and the sixth shaft 75. At this time, the wet towels are rapidly wound by the oppositely rotated rubber belt 65 and the ring belts 71, thereby shortening the length of the apparatus and allowing the longer towels to be wound by the apparatus.

When the thickness of the towel or the length of the towel is great, the diameter of the wound towel becomes great. As described above, since the sixth shaft 75 may be lifted up, the wound towels may pass the sixth shaft 75 without a hitch. By this construction, the apparatus according to the present invention may supply various lengths of wet towels to a user.

According one embodiment of the present invention, a towel is wound and supplied within 3–4 seconds per a sheet, and the maximum length of the towel that may be supplied by the apparatus ranges from 150 mm to 500 mm.

As shown in FIG. 7, the spread plate 67 is mounted using a spring 101, a washer 103 and a bolt 105 so as to be moved vertically, the bolt 105 being fixed to the side plate 64. This construction reduces the resistance of the apparatus, which is increased, accordingly as the diameter of the towel becomes larger. The roller 95 may be moved vertically together with the spread plate 67 and is rotated while in contact with the upper surface of the towel. As a consequence, the towel is conveyed while residual water is removed from the towel and the towel is spread uniformly.

As described above, the present invention provides an automatic wet towel supplying apparatus that is capable of regulating the length of a wet towel in accordance with a user's request. As a consequence, since a relatively large number of towels may be supplied by one time manipulation, the waste of power is prevented and the troublesomeness in manipulation is eliminated.

In addition, the present invention provides an automatic wet towel supplying apparatus that is capable of winding a towel while the towel is spread uniformly.

Furthermore, the present invention provides an automatic wet towel supplying apparatus that is capable of removing residual water from a towel using projections formed on the bottom surface of a spread plate.

Additionally, the present invention provides an automatic wet towel supplying apparatus that is capable of reducing the noise and the abrasion of the apparatus and being operated properly by employing sensors 47 and 51.

Furthermore, the present invention provides an automatic wet towel supplying apparatus in which a pulling means and a cutting means are mounted in a casing 11 that is easily mounted easily removed, thereby making the maintenance and the cleaning of the apparatus easy.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic wet towel supplying apparatus, comprising:

a housing including a cloth holding part for rotatably holding cloth in the form of a roll so that the cloth is pulled away and a towel storage chamber for storing cut, wet towels for supply;

a casing that is fixed to a front portion of an interior of the housing by means of bolts so as to be easily removed from the housing;

means for pulling the cloth while compressing the cloth, the pulling means including, a first motor, a first shaft that is connected to the first motor by means of gears, a second shaft that is operated together with the first shaft by means of a belt, a cover that is located above the belt while being fixed to the casing and a roller that is rotatably fixed while being projected from a bottom surface of the cover;

cutting means that includes a second motor, a rotary cutter rotated by the second motor, and a stationary cutter fixed at a position in which the stationary cutter intersects the rotary cutter;

water supplying means being mounted in the housing, including a water storage tank, a pump, a filtering unit and a nozzle, and serving to spray water on the cut towels; and control means that includes a control board mounted on an outer surface of the housing, a first sensor for sensing a length of the cloth that is pulled by the pulling means, a second sensor for sensing a total number of rotations of the rotary cutter of the cutting means, and a microprocessor for controlling power supply to the first motor, the second motor and the pump by processing the signals from the control board, the first sensor and the second sensor.

2. The apparatus according to claim 1, wherein said belt of said pulling means is a plurality of ring belts that pass the first shaft and the second shaft and are spaced apart from one another.

3. The apparatus according to claim 1, wherein said roller is elastically mounted to a bottom of the cover so as to treat various thicknesses of cloth by being moved elastically and vertically.

4. The apparatus according to claim 1, wherein said first sensor and said second sensor are tachometers, respectively.

5. The apparatus according to claim 1, wherein said control board of said control means includes select buttons for regulating a length of the wet towel and select buttons for selecting the number of wet towels.

6. The apparatus according to claim 1, wherein said water supplying means further includes a heating and cooling means for regulating a temperature of the water.

7. The apparatus according to claim 1, further comprising means for winding the wet towel and conveying the wound towel to the towel storage chamber, this means comprising, a third motor mounted in the housing, two side plates fixed to a frame while being spaced apart from each other, a third shaft rotatably mounted between front portions of the side plates, a fourth shaft connected to the third motor by means of gears and rotatably mounted between rear portions of the side plates, a rubber belt passing the third shaft and the fourth shaft and conveying the wet towels to the rear, a fifth shaft rotatably mounted between the side plates while being upwardly spaced apart from the rubber belt and connected to the fourth shaft by means of a belt, a sixth shaft rotatably mounted between the side plates while being upwardly spaced apart from the rubber belt and connected to the fifth shaft by means of ring belts so as to wind the towels, and a support plate serving to allow the wound towels, which pass the sixth shaft, to be moved to the wet towel storage chamber while the wound towels are in contact with the rubber belt and being extended so as to surround the rear portion of the rubber belt and the lower portion of the rubber belt while being spaced apart from the rubber belt.

8. The apparatus according to claim 7, wherein said sixth shaft is rotatably mounted to slots that are curvedly formed in the side plates so as to be moved upwards while connected to the fifth shaft.

9. The apparatus according to claim 7, further comprising a spread plate, the spread plate being mounted between both side plates, being positioned in front of the fifth shaft and being vertically spaced apart from the rubber belt.

10. The apparatus according to claim 9, wherein said spread plate has a plurality of tiny, sharp, flexible projections that remove residual water from the towel and spread the towel uniformly.

11. The apparatus according to claim 9, wherein said spread plate further includes two or more rollers that are projected downwards so as to be rotated while pressing against an upper surface of the towel.

* * * * *